United States Patent [19]

Atsuumi

[11] Patent Number: 4,960,081

[45] Date of Patent: Oct. 2, 1990

[54] BELT DRIVEN CAMSHAFT MECHANISM FOR INTERNAL COMBUSTION ENGINE

[75] Inventor: Mamoru Atsuumi, Iwata, Japan

[73] Assignee: Yamaha Hatsudoki Kabushiki Kaisha, Iwata, Japan

[21] Appl. No.: 285,781

[22] Filed: Dec. 16, 1988

[51] Int. Cl.[5] ..... F01P 1/06

[52] U.S. Cl. ..... 123/41.31; 123/195 C; 123/198 E; 474/93

[58] Field of Search ..... 474/93, 144, 146; 123/41.31, 41.56, 41.65, 195 C, 198 E, 90.31, 41.11; 290/1 B

[56] References Cited

U.S. PATENT DOCUMENTS 4,126,115 11/1978 List et al. ..... 123/198 E
4,373,480 2/1983 Shikata et al. ..... 123/41.11
4,516,596 5/1985 Choushi et al. ..... 123/195 C
4,598,671 7/1986 Glück et al. ..... 123/41.31

FOREIGN PATENT DOCUMENTS 829536 1/1952 Fed. Rep. of Germany ..... 474/93

*Primary Examiner*—Noah P. Kamen
*Attorney, Agent, or Firm*—Ernest A. Beutler

[57] ABSTRACT

A number of embodiments of internal combustion engines incorporating toothed belt driven overhead camshafts. In each embodiment, the driving belt is contained within a protective case that is separated from the engine by an air gap for insulation and a cooling fan driven by the camshaft circulates cooling air through the belt case. All embodiments employ air inlets for the belt case that are disposed in sheltered areas so as to prevent contaminants from being drawn into the belt case. In addition, a generator is contained within the belt case for protection.

28 Claims, 17 Drawing Sheets

BELT DRIVEN CAMSHAFT MECHANISM FOR INTERNAL COMBUSTION ENGINE

BACKGROUND OF THE INVENTION

This invention relates to a belt driven camshaft arrangement for an internal combustion engine and more particularly to an improved arrangement for insuring a long belt life without trouble.

In connection with the use of overhead camshafts for internal combustion engines, a wide variety of mechanisms have been employed for driving the camshafts from the engine crankshaft. There are a number of advantages to driving the camshafts by means of toothed belts as opposed to the gear or chain drives formerly used for this purpose. A toothed belt offers the advantage of simplicity, silence and also does not require lubrication. It is, of course, desirable to provide a long life for the driving belt so that high service intervals are possible and maintenance for the owner is reduced. In order to achieve this goal, it is important, among other things, to avoid excess heat being applied to the belt.

It is, therefore, a principal object of this invention to provide an improved arrangement for driving the camshafts of an internal combustion engine.

It is a further object of this invention to provide a valve driving arrangement for an internal combustion engine using a flexible toothed belt and a cooling arrangement for insuring that the belt is operated at a temperature that will offer a long life.

One way in which the belt life may be lengthened is by placing the belt is a protective casing. However, it must be insured that this casing does not permit the belt to become heated.

It is a further object of this invention to provide an improved protective casing for the belt drive of an engine valve train.

It is a further object of this invention to provide a heat insulating belt housing for the valve drive of an internal combustion engine.

In connection with the use of toothed belts for driving the valve train of an internal combustion engine, it is also desirable to protect the belts from contamination. Therefore, the enclosure of the belt within a protective housing will achieve this purpose but, as has been noted, this can present some problems in connection with maintaining the belt at a normal operating temperature. This cooling of the belt can be accomplished by providing an air flow path through the belt casing. However, the provision of an air flow path can give rise to the intrusion of foreign material into the belt casing that can damage the belt.

It is, therefore, a still further object of this invention to provide an improved belt casing arrangement having a ventilating device that will insure against the intrusion of foreign material into the belt casing.

When a valve drive belt is contained within a protective casing, it is further desirable if an arrangement can be incorporated for circulating air through the casing in order to cool the belt. However, the provision of a fan drive can give rise to difficulties in connection with the location and driving of the fan. Specifically, the drive for the fan and the fan location should be such that the size of the engine is not considerably enlarged.

It is, therefore, a still further object of this invention to provide an improved, compact driving arrangement for a fan for cooling the drive belt of an internal combustion engine valve train.

A number of accessories are also driven off the engine and frequently some of these accessories may be driven from the same drive belt as the valve train. Some of these accessories can benefit from the positioning within a drive belt casing since this will protect these accessories also from foreign material.

It is, therefore, a still further object of this invention to provide an improved accessory drive arrangement and protective casing for an internal combustion engine.

In connection with the use of drive belts or drive chains, it is also desirable to maintain the proper tension on the flexible transmitter that drives the camshaft. This is due to the fact that flexible transmitter, be they either drive chains or toothed belts, tend to elongated with age. Therefore, a wide variety of automatic or tensioning devices have been employed for maintaining the proper tension on the transmitter when such elongation occurs. However, the type of tensioners previously employed add significantly to the size of the engine.

It is, therefore, a still further object of this invention to provide an improved and compact flexible transmitter tensioner for the camshaft drive of an internal combustion engine.

It is a further object of this invention to provide a compact tensioner for a toothed driving belt of an engine.

SUMMARY OF THE INVENTION

Many of the features of the invention all are adapted to be embodied in an internal combustion engine that is comprised of a cylinder block having a cylinder bore, a cylinder head that closes the cylinder bore and valve means in the cylinder head for controlling flow. A piston is received in the cylinder bore and is drivingly connected to an output shaft that is journaled in a crankcase positioned at the end of the cylinder bore opposite to the cylinder head. A toothed belt is employed for driving the valve means from the output shaft.

In accordance with a first feature of the invention, a belt case encloses at least in substantial part the toothed belt and means define an insulating layer between the belt case and the cylinder block for limiting the transfer of heat from the cylinder block to the toothed belt.

In accordance with another feature of the invention, a belt case encloses at least in substantial part the toothed belt and means are provided for circulating cooling air through the belt case for cooling the toothed belt.

In accordance with a still further feature of the invention, a belt case encloses at least in substantial part the toothed belt and means permit cooling air to flow through the belt case from an inlet that is positioned in an area where contaminants are not likely to be through an outlet that is spaced from the inlet.

In accordance with yet a further feature of the invention, a belt case encloses at least in substantial part the toothed belt and a generator is contained within the belt case.

One feature of the invention is adapted to be embodied in a tensioner mechanism for a cam driving belt of an internal combustion engine. In accordance with this feature of the invention, a belt is trained around a sprocket fixed to the engine output shaft and drives the camshaft. A tensioning member is supported for movement closely adjacent the crankshaft driving sprocket and is yieldably biased into engagement with the transmitter for maintaining its tension.

DETAILED DESCRIPTION OF THE PREFERRED EMBODIMENTS

Figure 1:
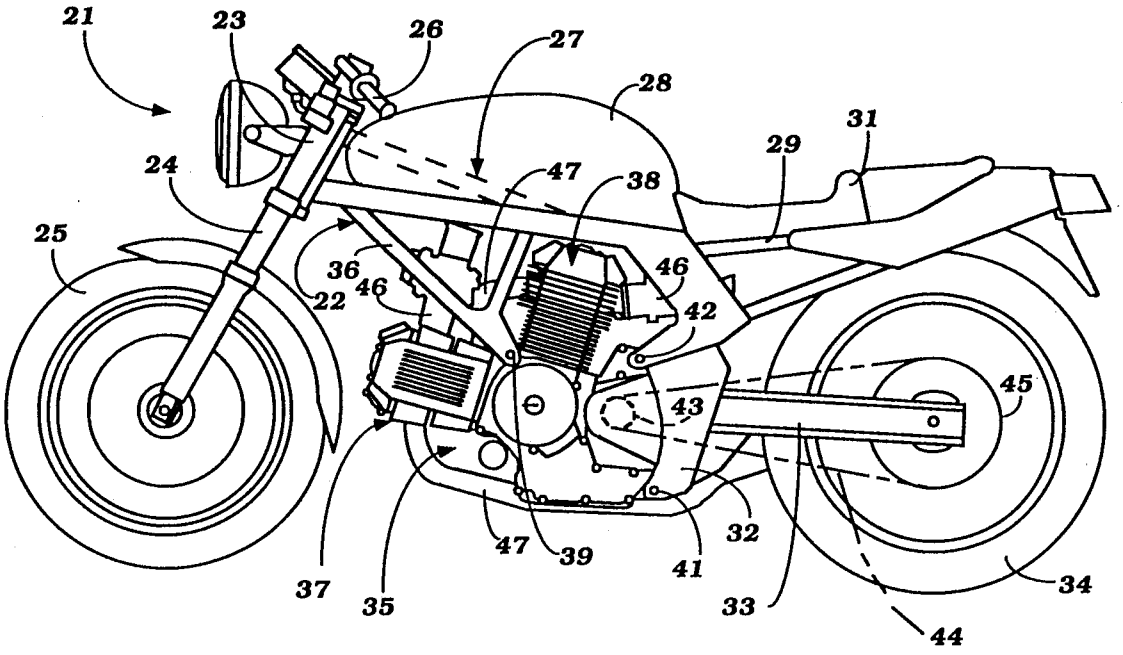
FIG. 1 is a side elevational view of a motorcycle constructed in accordance with an embodiment of the invention.
Figure 2:
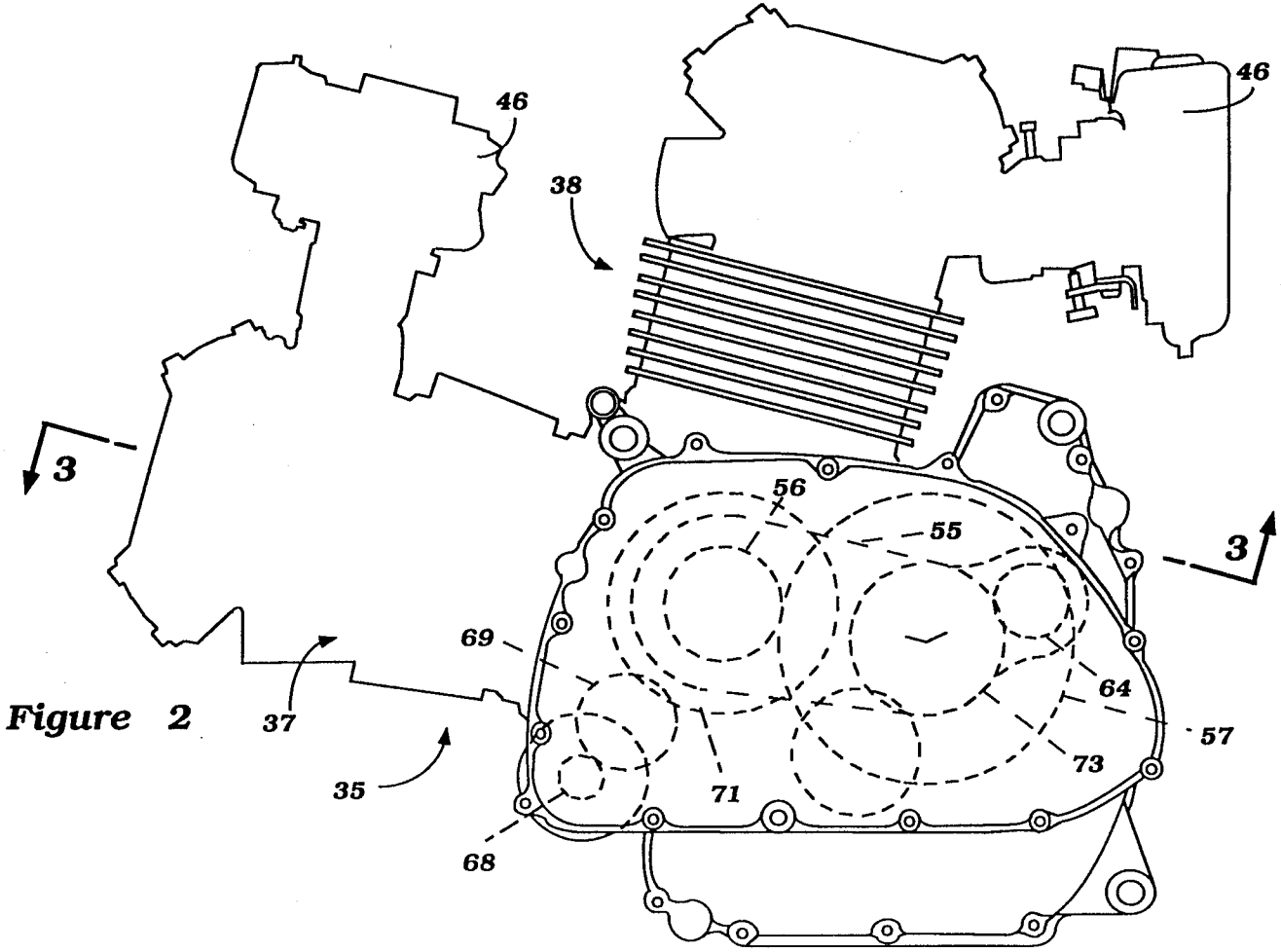
FIG. 2 is an enlarged side elevational view showing the engine with portions removed and other portions shown only in elevation.
Figure 3:
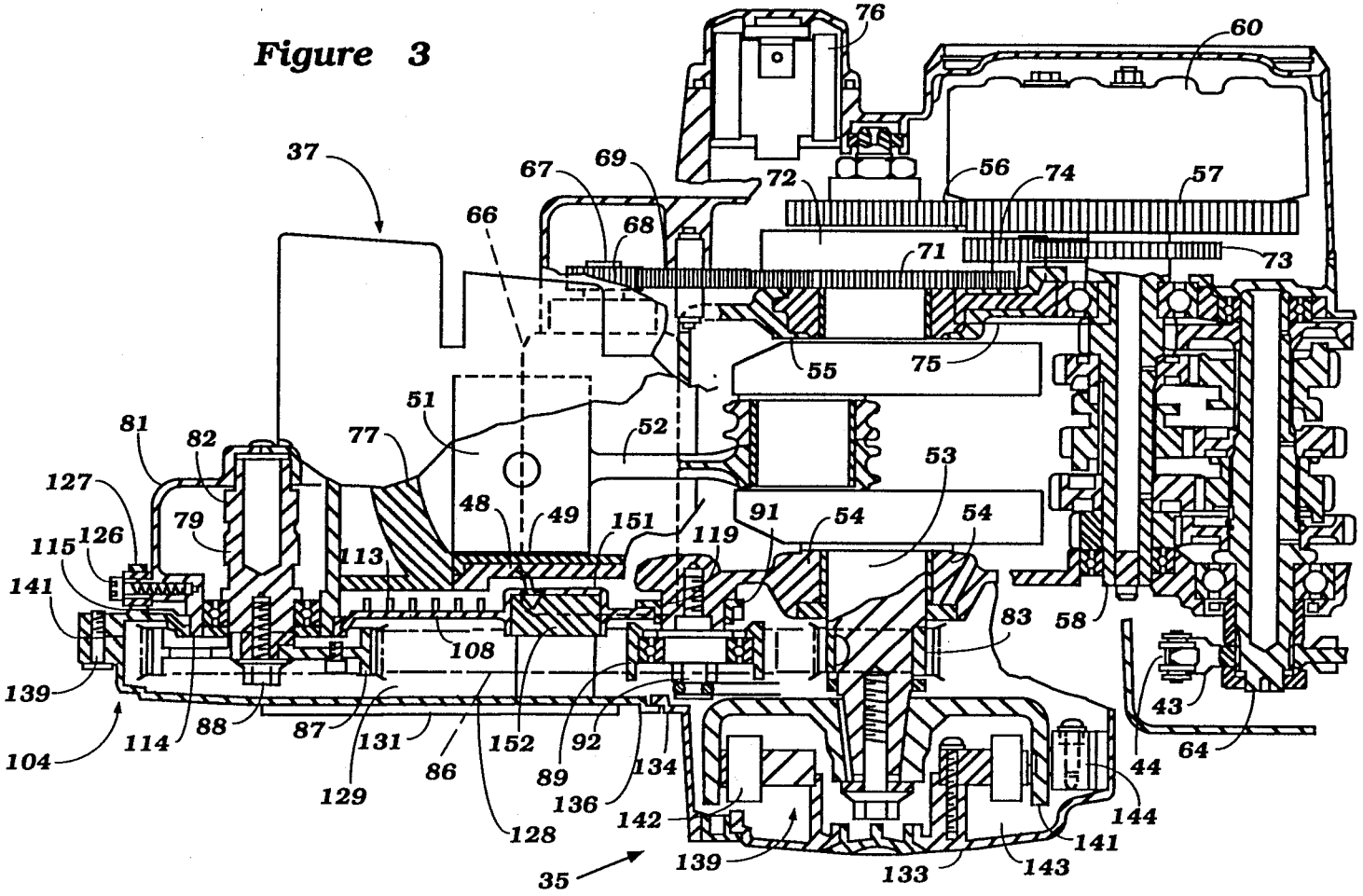
FIG. 3 is a cross-sectional view taken along the line 3—3 of FIG. 2.

The Environment Of The Invention - FIG. 1

Referring first to FIG. 1, this figure illustrates a motorcycle, indicated generally by the reference numeral 21, as a typical environment in which the invention may be practiced. A motorcycle is a particularly advantageous environment for the invention because the invention provides a compact arrangement for driving the valve train of an internal combustion engine and other associated components and for protecting the drive arrangement from the elements and from undue wear.

The motorcycle 21 is comprised of a frame assembly, indicated generally by the reference numeral 22, and comprised of a head pipe 23 that journals a front fork 24 for steering movement. A front wheel 25 is journaled at the lower end of the fork assembly 24 in a known manner and is steered by means of a handlebar assembly 26.

The frame assembly 22 further includes a main tube 27 that extends rearwardly and downwardly from the head pipe 23 and which mounts a fuel tank 28 in a known manner to the rear of the handlebar 26. At its rear end, the main pipe 27 is connected to a seat rail 29 on which a seat 31 is supported for accommodating a rider.

A frame casting member 32 is affixed at the juncture between the main frame tube 27 and the seat rail 29 and pivotally journals a trailing arm 33 that supports a driven rear wheel 34.

An internal combustion engine and transmission assembly, indicated generally by the reference numeral 35, and of a type to be described, is mounted within the frame assembly 22 by means including a subframe 36. The engine, transmission assembly 35 is, in this embodiment, of the V type and is comprised of a pair of angularly related cylinder banks 37 and 38. The engine 35 is disposed in the frame 22 so that the cylinder bank 37 extends generally horizontally in a forward direction while the cylinder bank 38, which is disposed at approximately a right angle to the cylinder bank 37, extends generally vertically.

The engine, transmission assembly 35 is mounted on the subframe 36 at a mounting point 39, which, as will be noted, may also coincide with the rotational axis of a component of the engine and specifically the valve train, and on the casting 32 at a mounting point 41. In addition, there is provided a mounting point 42 on the end of the frame member 27 completes the engine suspension in the frame.

The engine, transmission assembly 35 includes a change speed transmission, to be described, that drives an output shaft to which a driving sprocket 43 is affixed. A chain 44 encircles the sprocket 43 and a further sprocket 45 that is affixed to the rear wheel 34 for driving the rear wheel in a known manner.

Carburetors 46 supply a fuel/air mixture in a known manner to the cylinders of the banks 37 and 38. Exhaust gases are discharged from the cylinders of the cylinder banks 37 and 38 through exhaust pipes 47 which discharge downwardly and rearwardly in a suitable manner.

The Embodiment Of FIGS. 2 Through 7

As has been noted, the description of the construction in FIG. 1 is primarily in order to set the environment in which the invention is employed. The invention is particularly directed to the internal combustion engine 35 per se and a first embodiment will now be described by particular reference to FIGS. 2 through 7 with the initial emphasis being on FIGS. 2 through 5. The cylinder banks 37 and 38 are formed by a cylinder block 48 in which cylinder liners 49 are positioned. There will be at least one cylinder liner 49 in each cylinder bank 37 and 38 although it should be understood that the invention can be utilized in conjunction with engines other than the depicted V2 type.

Pistons 51 are slidably supported within the cylinder liners 49 and are connected to the upper ends of connecting rods 52 in a known manner. It should be noted that the cylinder banks 37 and 38 are staggered or offset transversely of the motorcycle and in the longitudinal direction of the engine so that the lower ends of the connecting rods 52 may be positioned in side by side relationship on a single throw of a crankshaft, indicated generally by the reference numeral 53. The crankshaft 53 is rotatably journaled within a crankcase 54 in a known manner. At one end of the crankcase 54, there is provided an insert 55 that journals the crankshaft 53.

A spur gear 56 is affixed to the end of the crankshaft 53 adjacent the insert 55 and meshes with a spur gear 57 that is affixed to one end of a primary or input shaft 58 of a change speed transmission, indicated generally by the reference numeral 59. As is normal practice with motorcycles, the change speed transmission 59 is contained within the crankcase 54. A clutch 60 selectively couples the input shaft 58 for rotation with the gear 57 and crankshaft 53.

A plurality of selectively engageable gear sets 61, 62 and 63 are provided for selectively coupling the primary shaft 58 for rotation with a secondary or output shaft 64 of the transmission 59. The driving sprocket 43 for the rear wheel driving chain 44 is affixed to the end of the transmission secondary or output 64 in a known manner for driving the rear wheel 34 at selected speed ratios as accommodated by the change speed transmission 59.

A starter motor 66 is disposed to one side of the crankcase 54 and has its output shaft 67 extending into the interior of the crankcase 54. A starter gear 68 is affixed to the starter shaft 67 and meshes with an idler gear 69 which, in turn, drives a starter gear 71 that is journaled on the crankshaft 53. The starter gear 71 can be selectively coupled to rotate the crankshaft 53 for starting operations through a one-way clutch 72 in a known manner.

An oil pump drive gear 73 is affixed to the transmission input gear 57 and meshes with a driven gear 74 of an oil pump, indicated generally by the reference numeral 75 for driving the oil pump 75. The oil pump 75 circulates lubricant from the crankcase 54 to the engine and transmission for lubricating it through a known lubricant system which includes an oil filter 76.

Cylinder heads 77 are affixed to the cylinder block 48 in a known manner to each of the cylinder banks 37 and 38 at the end opposite the crankcase 54. The cylinder heads 77 mount spark plugs 78 for firing the charge within the combustion chambers in a known manner. Intake gases flow into the chambers and exhaust gases flow out of the chambers through valved passageways (not shown) that are controlled by a valve train that is operated by means of overhead mounted camshafts 79. The camshafts 79 are mounted in cam covers 81 that are affixed to the cylinder heads 77. Cam lobes 82 are formed on the camshafts 79 for operating these valves either directly or indirectly in any suitable manner.

It should be understood that the construction of the engine as thus far described may be considered to be generally conventional. The invention is directed primarily toward the arrangement for driving the camshafts 79 and certain other accessories, as will now be described.

A driving sprocket 83 is affixed to the forward end of the crankshaft 53 for rotation with the crankshaft by means of a keyway 84 and locking nut 85. A toothed flexible belt 86 is driven by the sprocket 83 and is trained around a pair of driven sprockets 87 that are affixed to the ends of the camshafts 79 by means including locking bolts 88. A first idler pulley 89 is journaled for rotation by a front wall of the crankcase 54 adjacent a recess 91 formed therein by means of a pivot bolt 92. The idler pulley 89 engages the backside of a flight of the belt 86 that runs from the crankshaft sprocket 83 to the camshaft sprocket 87 associated with the cylinder bank 37.

Figure 10:
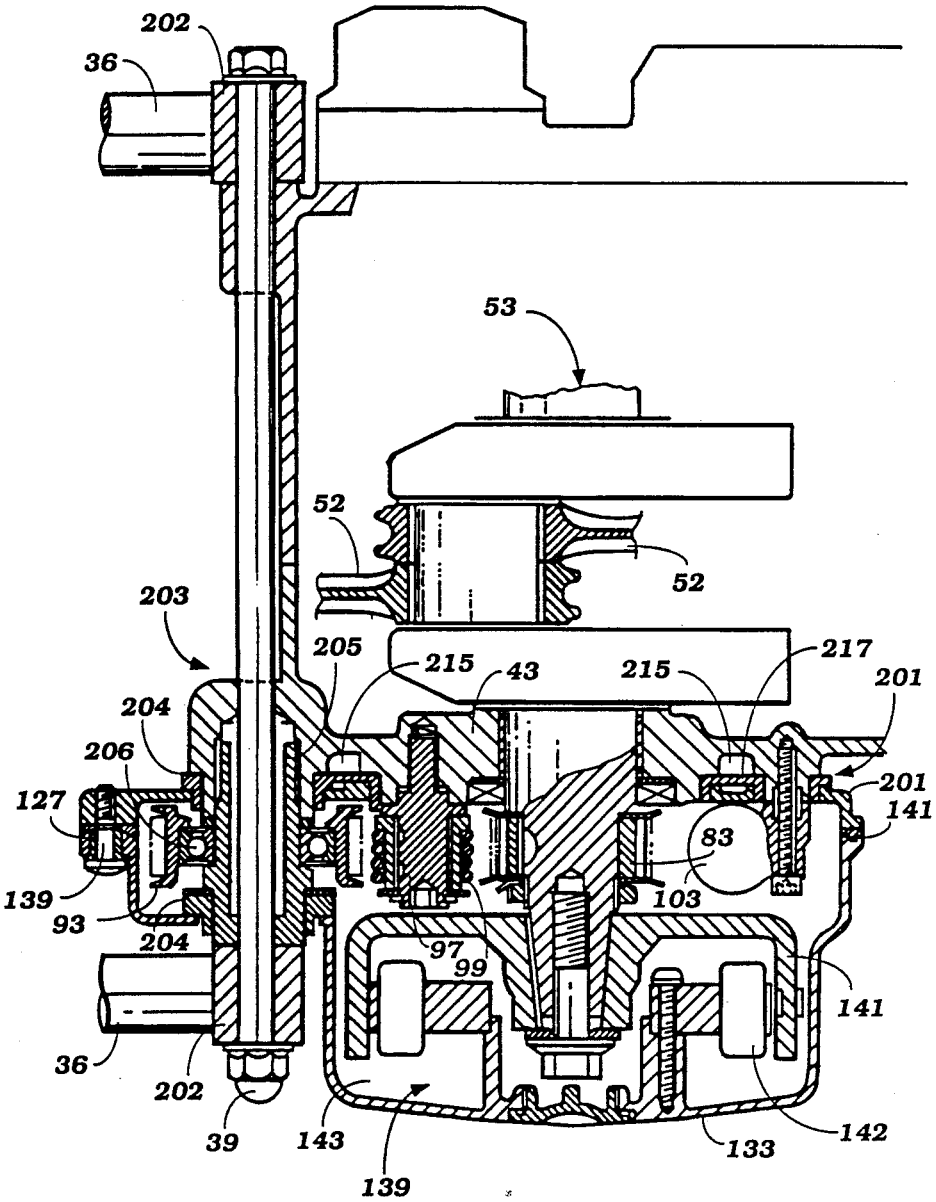
FIG. 10 is an enlarged cross-sectional view taken along the line 10—10 of FIG. 8.

From the sprocket 87 associated with the cylinder bank 37, a flight of the drive belt 86 extends downwardly back toward the crankshaft sprocket 83 where it engages a second idler pulley 93 that is journaled on the mounting bolt 39 in a manner as shown in FIG. 10. This construction will be described in conjunction with the embodiment of FIGS. 8 through 13. A flight of the belt 86 then drives the sprocket 87 associated with the cylinder bank 38 and then passes over a tensioner pulley 95 before it again engages the crankshaft sprocket 83. The tensioner pulley 95 is journaled on a tensioner arm 96 adjacent the crankshaft 53 which is, in turn, journaled on a shaft 97 that has a threaded connection to the crankcase 54. A snap ring 98 serves the purpose of holding the arm 96 in position. A torsional spring 99 is wound around the shaft 97, in a manner as will be described in conjunction with the embodiment of FIGS. 8 through 12, and has one end engaged with the pivot bolt 92. The opposite end of the spring is engaged with a bolt 101 that is threaded into the arm 96 for normally urging the arm 96 and tensioner pulley 95 in a direction to maintain tension. In addition, an auto tensioner 102 engages a lug 103 on the arm so as to automatically set the amount of free play in the belt 86 in a manner as will be described by reference to the embodiment of FIGS. 8 through 13.

Obviously, it is desirable to protect the belt 86 and also to insure that the belt 86 does not become heated. In order to achieve these results, the belt 86 is contained within a protective belt case, indicated generally by the reference numeral 104, and comprised of an inner portion 105, which is shown in most detail in FIG. 6, and an outer portion that is indicated generally by the reference numeral 107 and which is comprised of three parts to be described. The case portion 105 is formed from a lightweight alloy casting such as aluminum and has a pair of arms 108 and 109 that are associated with the cylinder banks 37 and 38 eespectively. It will be noted that a first air gap 111 is formed between the arm 108 and the cylinder bank 37 and a second gap 112 is formed between the cylinder bank 38 and the arm 109. The air gap 112 is wider than the air gap 111 due to the aforenoted staggering of the cylinder banks. The air gaps 111 and 112 will insure that heat will not be transferred between the cylinder block 48 and the case portion 105. In addition, cooling fins 113 are formed on the case portion 105 so as to assist in heat dissipation from the belt 86.

The arm 108 of the case portion 105 has an enlarged opening 114 to pass a projection of the cam carrier 81. An elastic sealing gasket 115 is carried by the case portion 105 around the opening 114 and sealingly engages this projection of the cam carrier 81. In a like manner, an opening 116 is formed in the arm 109 and carries a sealing member 117 for engaging a similar projection on the cam carrier 81 associated with the cylinder bank 38. A scroll portion 118 encircles the opening 116 for a reason to be described.

A pair of openings 119 and 121 are formed at the base of the arms 108 and 109 of the cover portion 105 and pass projections formed on the crankcase 54 around the recess 91 so as to receive these projections. Seals 122 sealingly engage the openings 119 and 121 and the crankcase projections for sealing these areas. Thus the front wall of the crankcase forms a portion of the belt case in this embodiment. The cover portion 105 is held to the cylinder block 48 and cam carriers 81 by means of a plurality of threaded fasteners such as fasteners 123 that engage the crankcase 54 and pass through openings 124. Recesses or bores 125 may also be formed in the case portion 105 to receive locating pins (not shown). Threaded fasteners 126 pass through openings in which grommets 127 are received (FIG. 5) so as to affix the cover portion 105 to the cam carriers 81.

Figure 4:
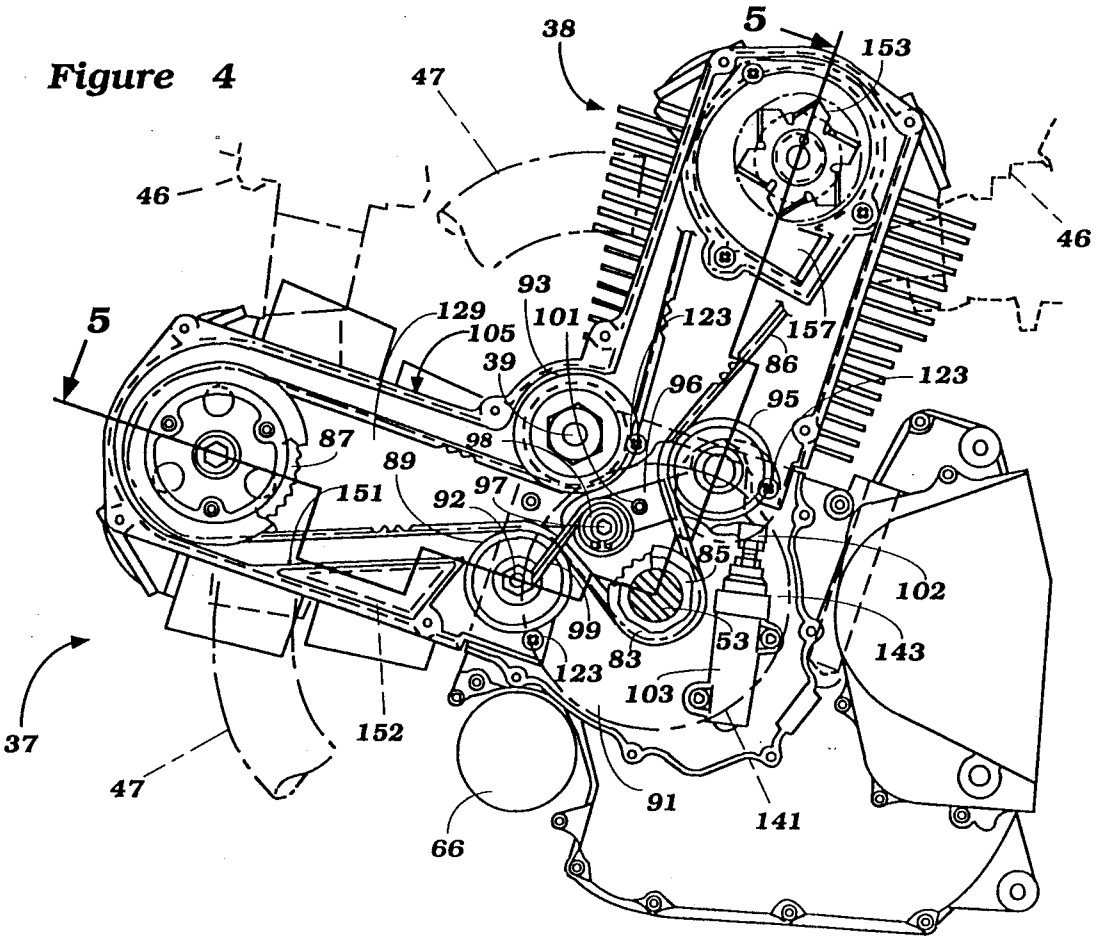
FIG. 4 is a side elevational view of the engine with a portion of the belt case removed.
Figure 5:
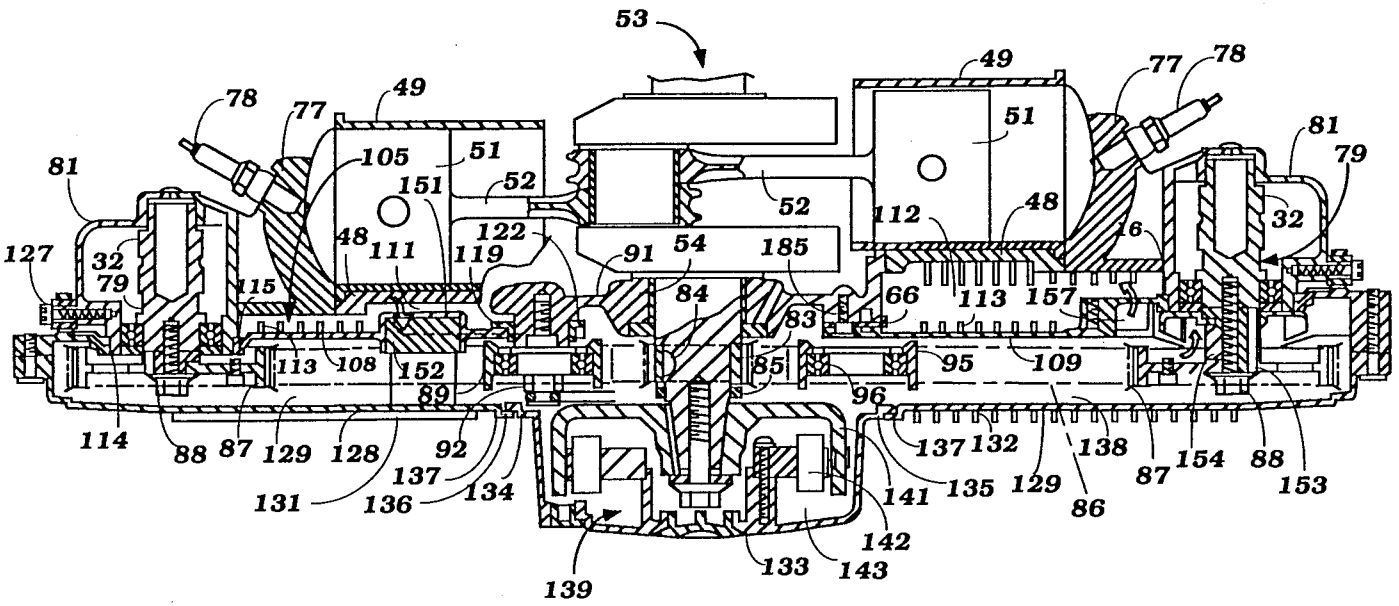
FIG. 5 is a cross-sectional view taken along the line 5—5 of FIG. 4.
Figure 6:
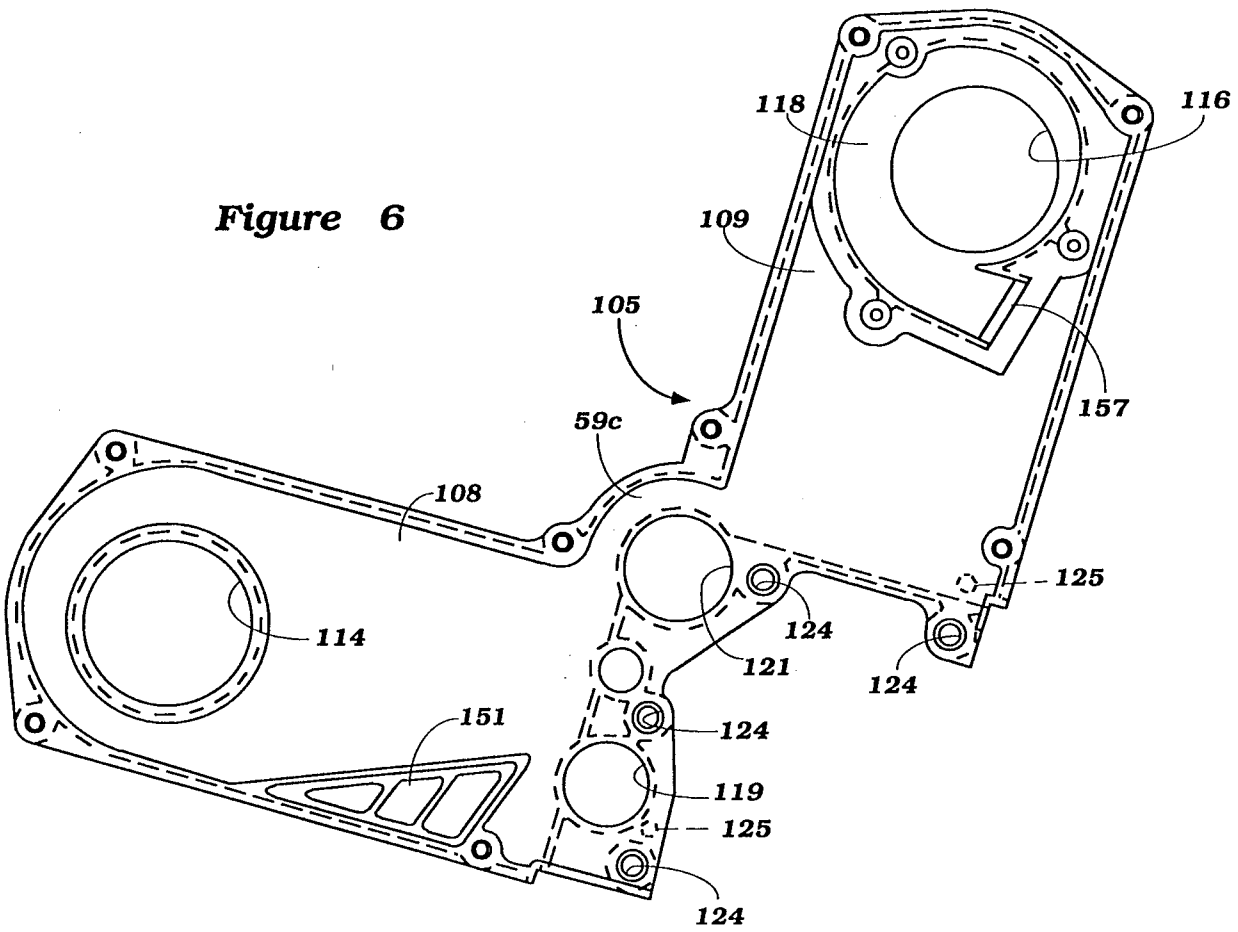
FIG. 6 is an end elevational view of the inner portion of the drive belt cover.
Figure 7:
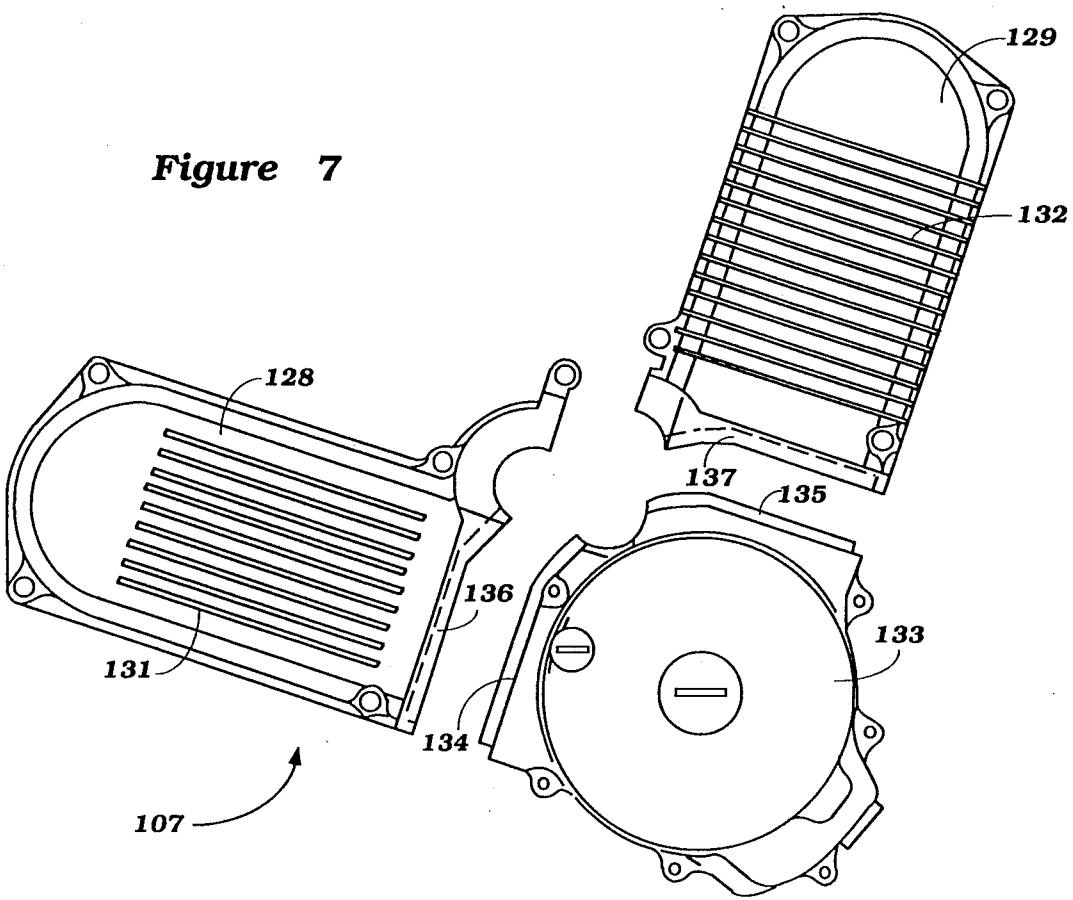
FIG. 7 is an end elevational view, partially exploded, of the outer portion of the drive belt cover.
Figure 8:
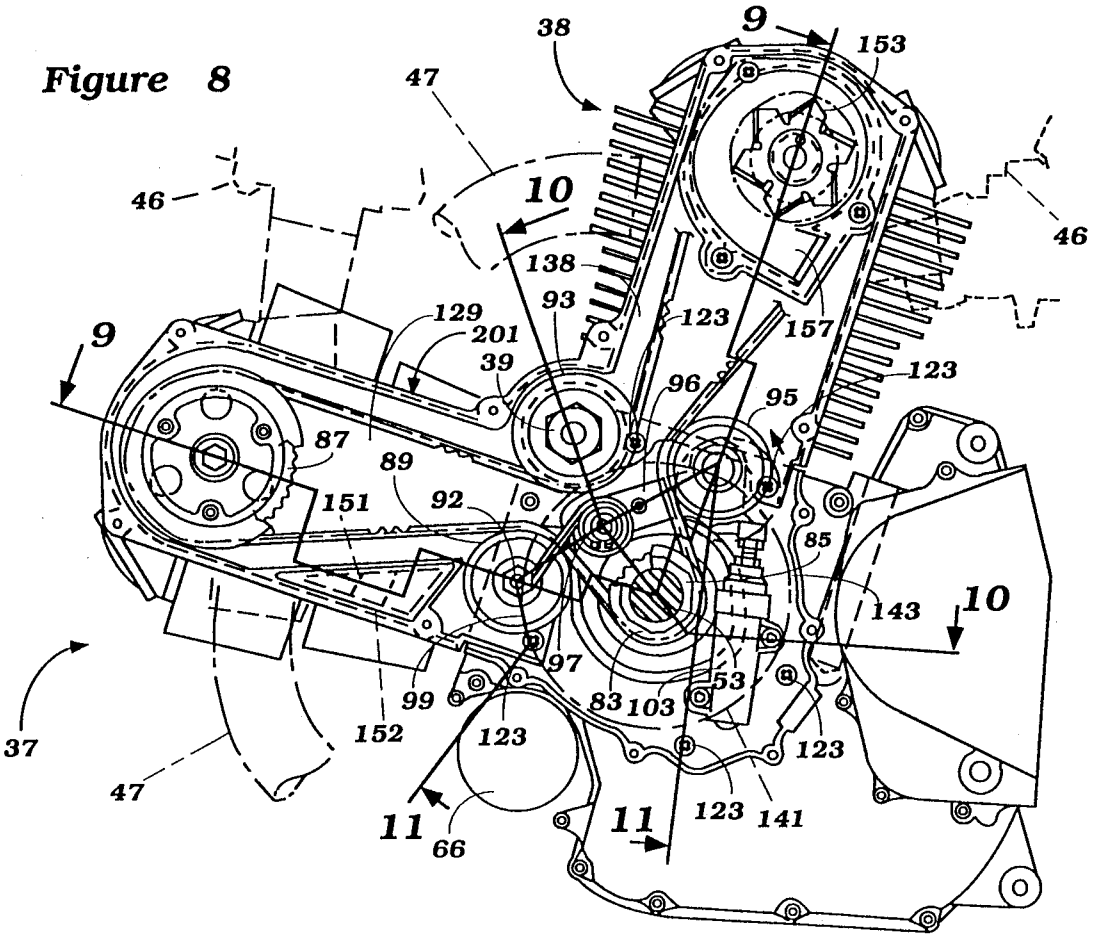
FIG. 8 is a side elevational view, with portions removed, in part similar to FIG. 4, showing another embodiment of the invention.
Figure 9:
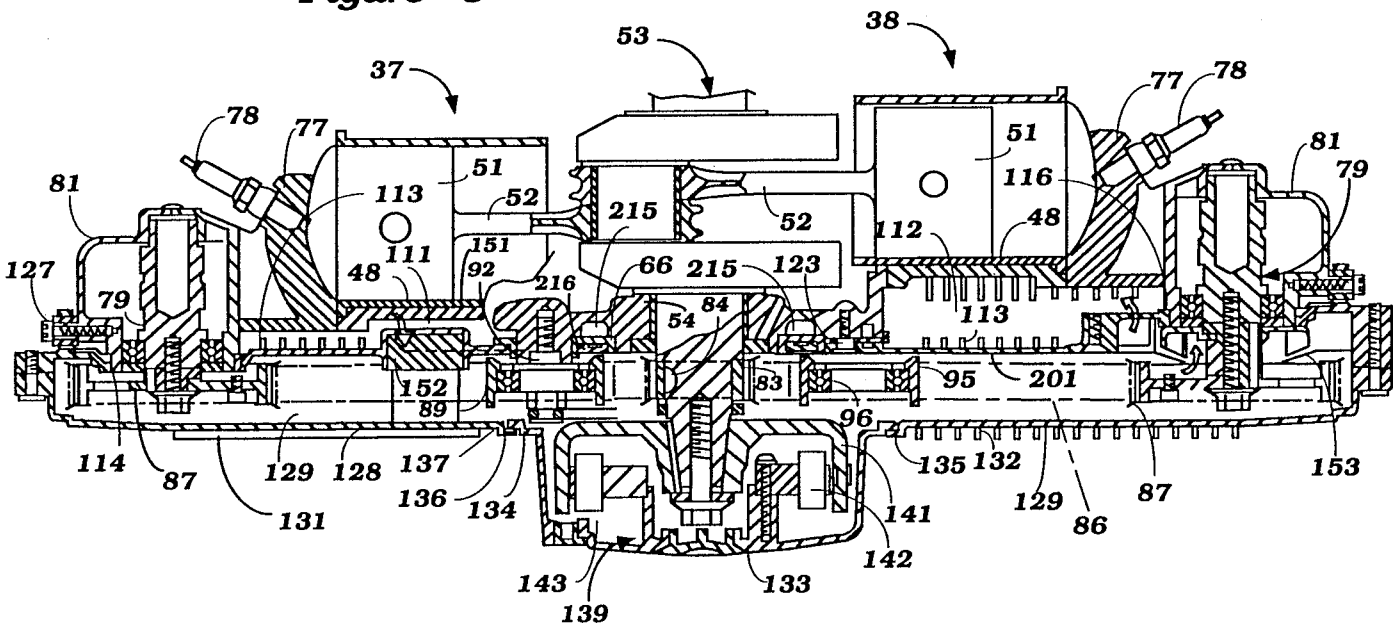
FIG. 9 is a cross-sectional view taken along the line 9—9 of FIG. 8.

Referring now primarily to FIG. 7 but additionally to FIGS. 4 and 5, the outer chain case portion 107 which is also formed of light alloy or aluminum is comprised of a first part 128 that cooperates with the arm 108 of the belt case part 105 to define a first belt cavity 129 in which the flight of the belt between the crankshaft sprocket 83 and camshaft sprocket 89 of the bank 37 is enclosed. A second part 129 encloses the remaining belt flight and cooperates with the arm 109 of the housing portion 105. The arms 128 and 129 are provided with respective cooling fins 131 and 132. A third part 133 completes the outer portion 107 and is affixed to the crankcase 54. The part 133 has flange portions 134 and 135 that are received within respectively grooves 136 and 137 of the parts 128 and 129, respectively, so as to provide a relatively air tight enclosure. It should be noted that the cover part 129 and the arm 109 define a further belt chamber 138 in which the flight of the belt 86 between the crankshaft sprocket 83 and sprocket 87 of the cylinder bank 38 is enclosed.

The cover parts 128, 129 and 133 and cover portion 105 are all held together by means of a plurality of threaded fasteners 139 with a gasket or gaskets 141 being interposed between the various cover parts.

In accordance with a feature of the invention, a generator or alternator, indicated generally by the reference numeral 139, is disposed within the belt casing 104 and specifically beneath the cover part 133. The alternator or generator 139 is comprised of a rotating magnet 141 that is affixed for rotation with the crankshaft 53 and which cooperates with a plurality of stationary coils 142 carried by the cover part 133 for generating electricity in a known manner. A cavity 143 is formed by the cover part 133 so as to contain and protect these elements from foreign matter and lubricant. In this way, it is not necessary for the generator 139 to have a separate cover and thus the device can be generally open and easily cooled.

There is also incorporated as part of the generator 139 a pickup coil 144 which may be a portion of the ignition system of a known type for triggering the firing of the spark plugs 78 in a known manner.

The enclosure of the drive belt 86 within the belt case 104 will protect it and will tend to insulate it from the heat generated by the engine and specifically coming from the cylinder block 49 due to the air gaps 111 and 112. However, there may be heat generated from the flexure of the belt 86 and in order to dissipate heat from the cavities 129 and 138, there is provided an atmospheric air inlet opening 151 in a rear face of the drive belt casing part 105. This opening 151 is disposed in relation to the air gap 111 so that the air that enters the opening 151 will be air that is generally contamination free since foreign matter is not likely to find its way into this cavity. Furthermore, an air filter 152 is contained within the housing piece arm 108 so as to filter this cooling air that flows in. As a result, the drive belt will be protected from contamination as will the generator 139.

Air is circulated through the belt case 104 by means of a fan 153 that is driven from the camshaft 79 associated with the cylinder bank 38. It will be noted from FIG. 5 that the fan 153 is disposed in the offset area caused by the stagger between the cylinder banks 37 and 38 so that it will not encroach upon the overall size of the engine. The fan 153 is positioned within the scroll recess 118 of the housing arm 109. A spacer 154 is interposed between the sprocket 87 and camshaft 79 so as to locate the fan 153. A drive pin 155 insures that the fan will rotate. In addition, a baffle plate 156 may be positioned over the scroll opening 118 so as to provide the desired flow pattern. The air which is exhausted from the drive belt case 104 is exhausted through an exhaust opening 157. This exhausted air is easily discharged to the atmosphere and can also be utilized for cooling the cylinder bank 38, if desired.

Embodiment Of FIGS. 8 Through 13

FIGS. 8 through 13 show another embodiment of the invention which is generally similar to the embodiment of FIGS. 2 through 7. For that reason, components of this embodiment which are the same as the previously described embodiment will be identified by the same reference numerals and will only be described again insofar as is necessary to understand the construction and operation of this embodiment. In addition, as has been previously noted, further details of the mounting arrangement for the idler pulley 93 and the construction and operation of the automatic chain tensioner 103 will be given in connection with the description of this embodiment.

Basically, this embodiment differs from a previously described embodiment in that the inner belt case portion, which is indicated generally by the reference 201 in this embodiment, is constructed in such a way that it forms the complete inner closure for the belt case and thus does not rely upon a portion of the crankcase for this purpose as with the previously described embodiment. In this way, this embodiment provides further insulation of the interior of the belt case from the engine.

Before describing the construction of the belt case portion 201, the mounting arrangement for the idler pulley 93 and its relationship to the supporting bolt 36 will be described by particularly reference to FIG. 10. It should be noted that the supporting bolt 39 passes through a pair of trunnion portions 202 supported in the subframe 36. This bolt also passes through a boss 203 formed in the crankcase 43. A pair of sealing gaskets 204 are positioned between the cover assembly 104 and the area where the bolt passes. An annular bushing 205 is contained within the crankcase and the idler sprocket 93 is journaled on this bushing by means of a ball bearing 206.

Figure 11:
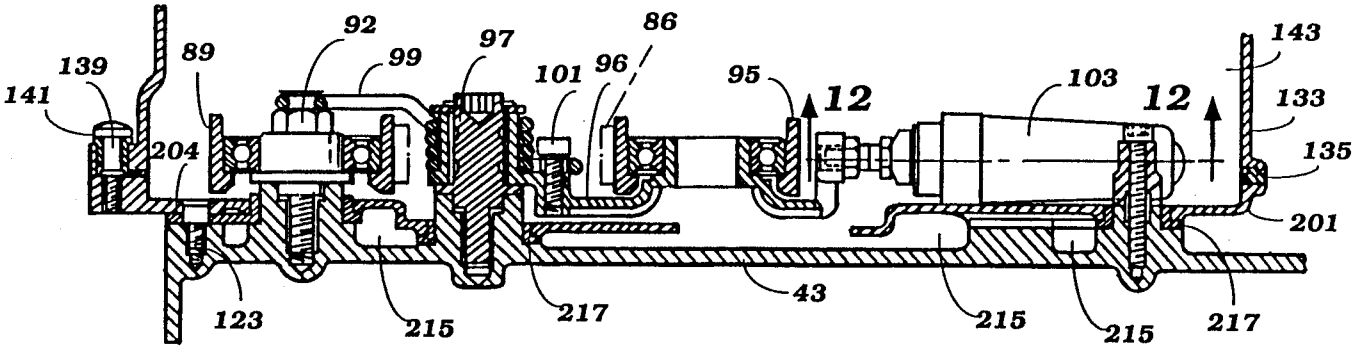
FIG. 11 is an enlarged cross-sectional view taken along the line 11—11 of FIG. 8.
Figure 12:
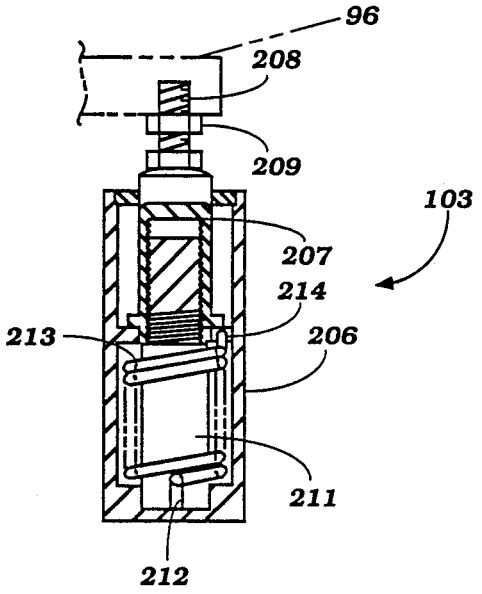
FIG. 12 is a cross-sectional view taken along the line 12—12 of FIG. 11 and shows the automatic belt tensioner.
Figure 13:
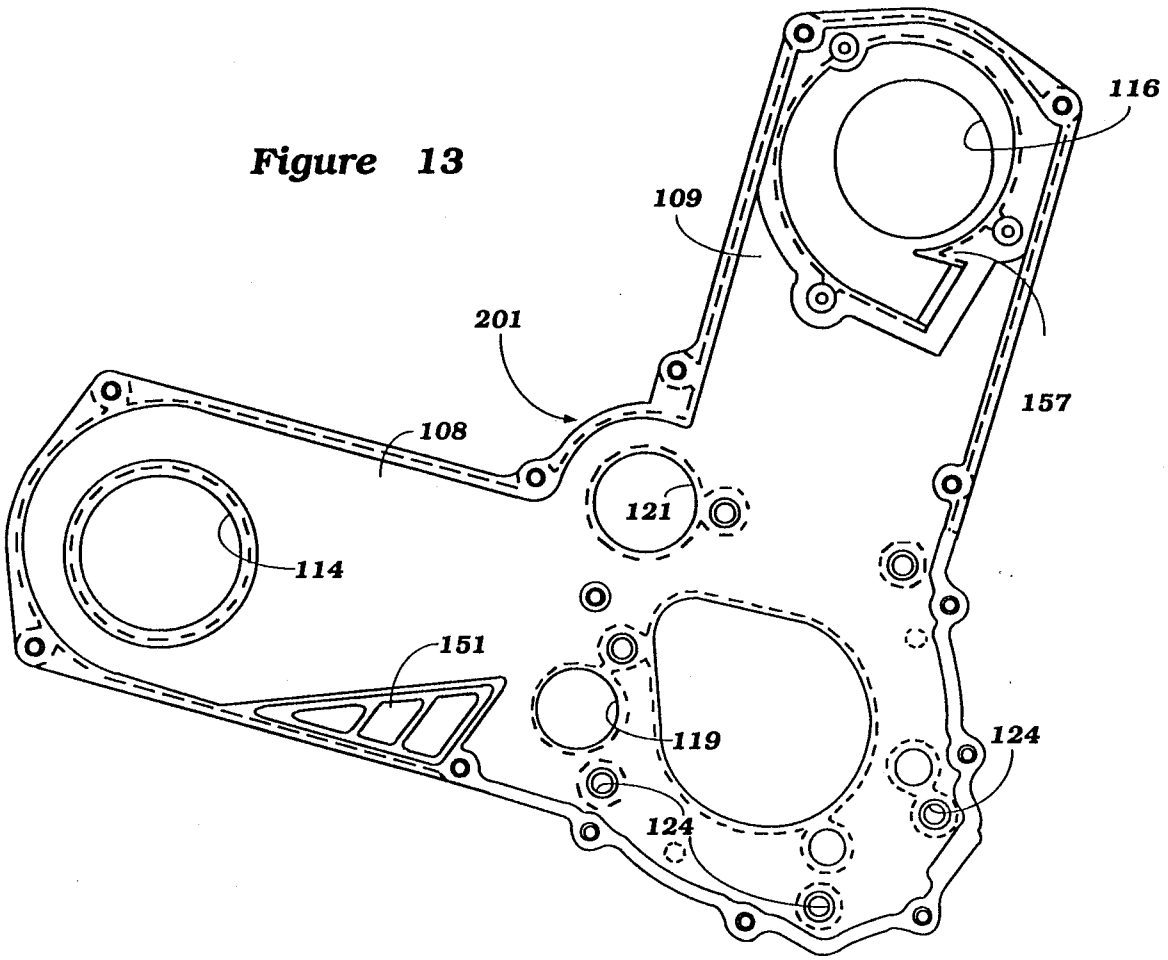
FIG. 13 is an end elevational view of the inside portion of the drive belt cover of this embodiment.

The construction and operation of the automatic chain tensioner 103 will now be described by particular reference to FIGS. 11 and 12. Referring primarily to FIG. 12, the tensioner 103 includes an outer housing or body 206 that defines a cylindrical cavity in which an internally threaded abutment member 207 is supported. The abutment member 207 bears against a bolt 208 that is fixed to the arm 96 by means of a threaded connection and lock nut 209.

The internally threaded member 207 is engaged with an externally threaded member 211 that is positioned within the housing 206 and which has a slot 212 at its lower end. One end of a torsional spring 213 is received in the slot 212 and the other end is trapped in a groove 214 of the housing. The threaded connection is such that the spring 213 tends to cause the member 207 to move outwardly. The amount of outward movement is limited by the contact of the member 207 with the bolt 208 so as to prevent overtensioning. However, as the belt 86 stretches and the arm 96 pivots, the follower 207 will follow it and insure that excess kickback of the drive belt does not occur.

Referring now to the construction of the inner belt case portion 201, it will be seen that, unlike the embodiment of FIGS. 2 through 7, the portion 201 extends across the crankcase 54 and defines an annular air gap 215 around the crankcase so as to provide further insulation between an inner wall 216 of the belt case portion 201 and a sealing gasket 217 interposed therein to insure good heat sealing. In all other regards, the construction of the portion 201 is the same as the previously described embodiment and, for that reason, parts of the portion 201 which are the same as the previously described embodiment have been identified by the same reference numerals and will not be described again.

Figure 14:
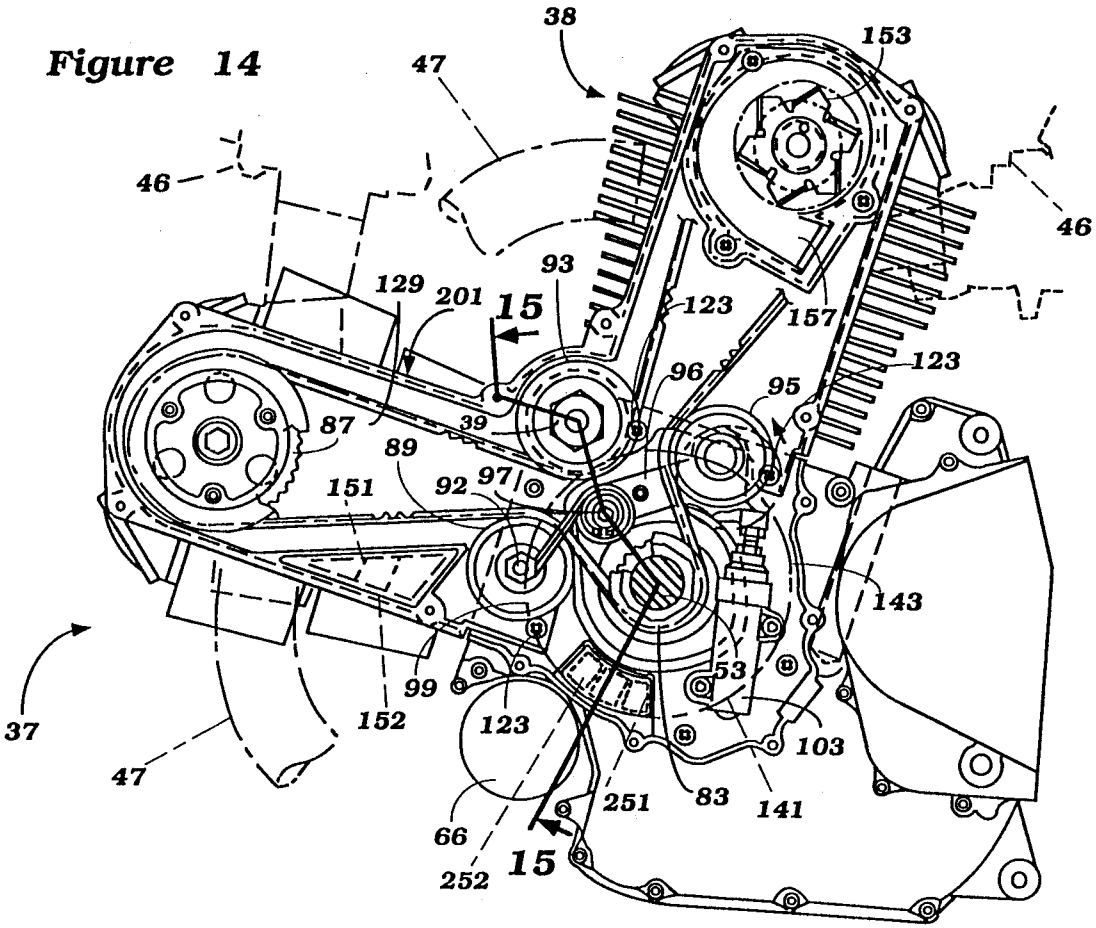
FIG. 14 is a side elevational view, with portions removed, in part similar to FIGS. 4 and 8, showing a third embodiment of the invention.
Figure 15:
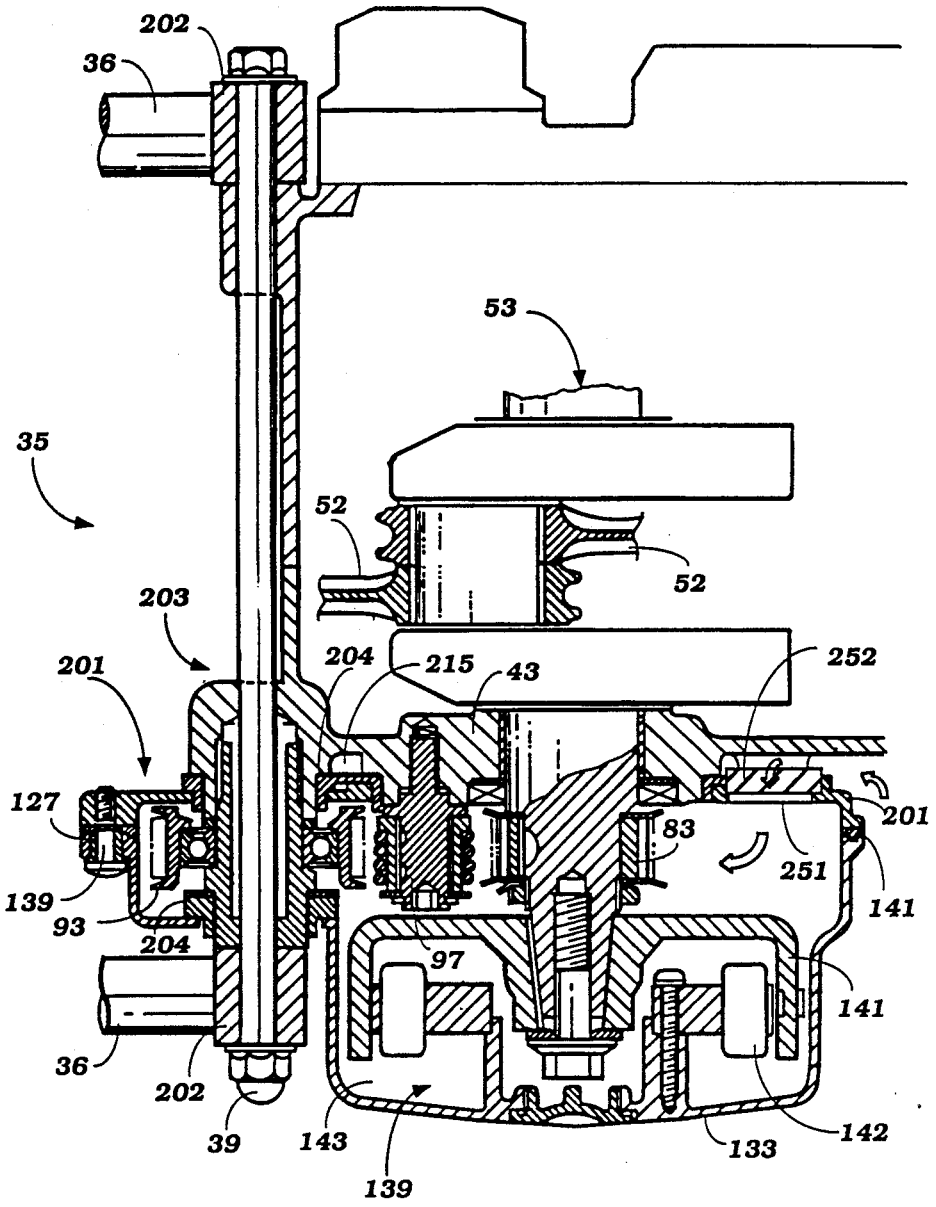
FIG. 15 is an enlarged cross-sectional view taken along the line 15—15 of FIG. 14.

Embodiment Of FIGS. 14 and 15

This embodiment is substantially the same as the embodiment of FIGS. 8 through 13 and, for that reason, the components of this embodiment which are the same as that embodiment have been identified by the same reference numerals and will not be described again.

In this embodiment, the generator or alternator 139 is further cooled by providing an air inlet opening 251 in the inner case portion 201 in registry with the generator 139. The opening 251 is positioned on the back side of the case 104 so as to insure that foreign material will not enter and contaminate the generator 139 or drive belt 86. In addition, a filter element 252 is provided across the opening 251 so as to filter any inlet air and remove foreign particles that might otherwise cause problems. In all other regards, this embodiment is the same as the previously described embodiment.

Figure 16:
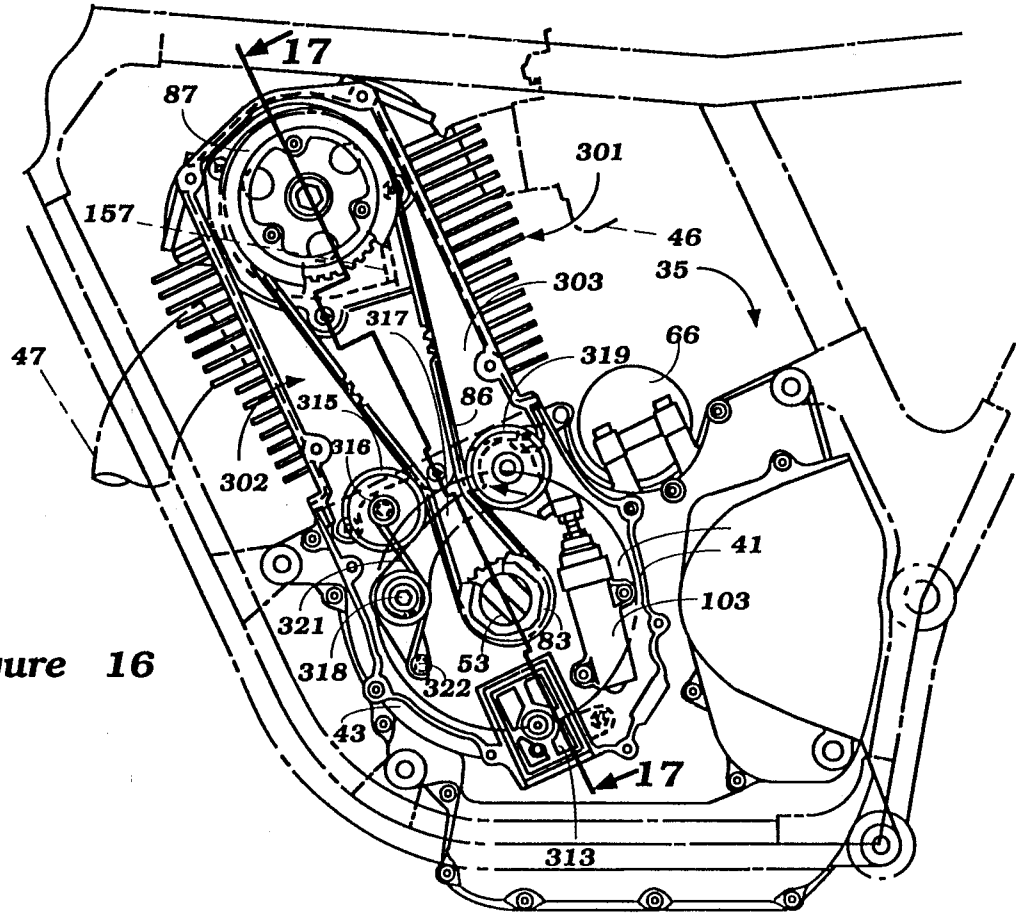
FIG. 16 is a side elevational view, with a portion removed, in part similar to FIGS. 4, 8 and 14, showing a fourth embodiment of the invention.
Figure 17:
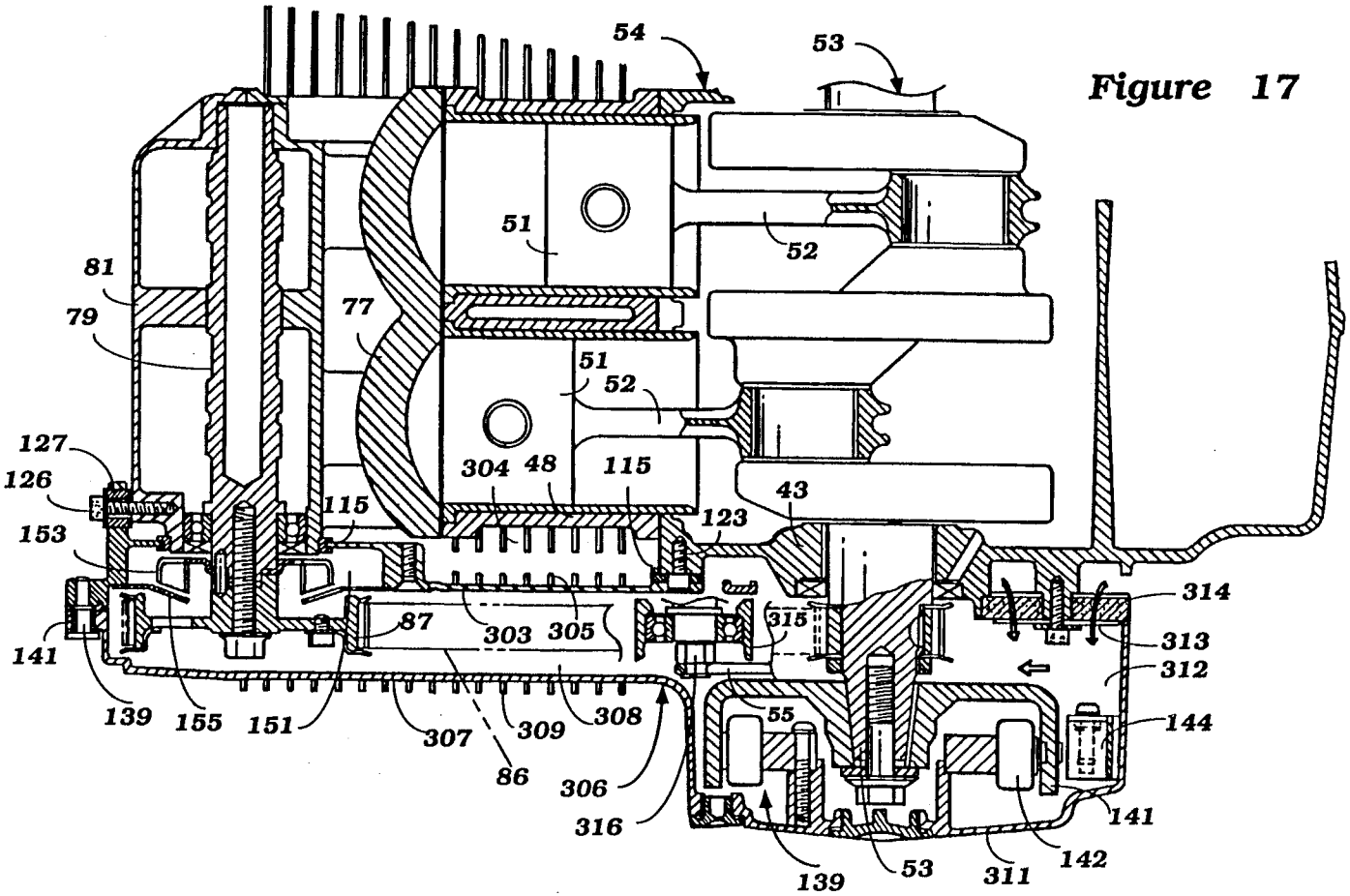
FIG. 17 is an enlarged cross-sectional view taken along the line 17—17 of FIG. 16.

Embodiment of FIGS. 16 and 17

In all of the embodiments of the invention as thus far described, the construction has been embodied in a V type engine. However, many facets of the invention can be utilized in conjunction with inline type engines and FIGS. 16 and 17 depict such an embodiment. In this embodiment, the engine may be considered to be the same as a single bank of the previously described embodiments, however, in this embodiment, the two cylinders are formed in the same bank. As has already been noted, however, the invention is capable of use with other than two cylinder engines.

In this embodiment, inasmuch as the engine has only one cylinder bank, the belt case, indicated generally by the reference numeral 301, has only one arm portion defining a cavity 302. However, because of the similarity of the construction to the previously described embodiment, components which are the same or substantially the same are identified by the same reference numerals and will not be described again, except insofar as is necessary to understand the construction and operation of this embodiment.

In this embodiment, the belt case 301 has a construction of the type generally disclosed in the embodiment of FIGS. 2 through 7. That is, the belt case 301 is comprised of an inner portion 303 which is spaced from the cylinder block 48 by an air gap 304 for heat insulating purposes. Cooling fins 305 are formed on the inner portion 303 for the aforedescribed purposes.

In this embodiment, the outer portion, indicated generally by the reference numeral 306, is comprised of two portions, a first part 307 which defines with the portion 303, a chamber 308 in which the belt 86 is contained. The portion 307 is also provided with cooling fins 309. A second part 311 is affixed to the first part 307 and overlies and encloses the generator 139 within an air space 312.

In this embodiment, air enters the air space 312 through air inlet openings 313 across which a filter element 314 is positioned. The air is circulated by a fan 153 driven by the single camshaft 79 as should be readily apparent.

Because the drive belt 86 has only a single flight, the tensioner arrangement is slightly different from the previously described embodiment. In this embodiment, there is provided an idler pulley 315 on one side of the belt which is mounted upon a shaft 316. A support arm 317 is pivotally supported on a shaft 318 and carries a tensioner pulley 319 that is disposed on the other side of the drive belt 86 from the idler pulley 315. A torsional spring 321 operates on the support arm 317 and has one of its ends anchored to a pin 322 on the support arm for yieldably biasing the arm 317 in a direction to maintain the tension on the belt 86. The automatic tensioner 103, as in the aforedescribed constructions, limits the amount of kick back and controls the tensioning on the drive belt 86.

Therefore, it should be readily apparent that this construction is generally the same as the previously described embodiments and further description of it is not believed to be necessary.

In view of the foregoing, it is believed that a number of embodiments of the invention have been illustrated and described, each of which provides a very effective valve train driving mechanism for an internal combustion engine employing a toothed belt that is well protected and cooled and an improved tensioner arrangement for that belt. Although a number of embodiments of the invention have been illustrated and described, various changes and modifications may be made without departing from the spirit and scope of the invention, as defined by the appended claims.

I claim:

1. In an internal combustion engine comprising a cylinder block having a pair of cylinder banks each defining a cylinder bore, a cylinder head for each bank for closing the respective cylinder banks of the cylinder bore, valve means in said cylinder heads for controlling flow, a piston received within said cylinder bores and driving an output shaft journaled in a crankcase positioned at the end of said cylinder bores opposite to said cylinder heads, and a toothed belt having a pair of flights each driving a respective one of said valve means from said output shaft, the improvement comprising said cylinder banks being staggered relative to each other with respect to the axis of said output shaft, a belt case having a pair of arms each enclosing at least in substantial part one of said flights of said toothed belt, means for affixing said belt case relative to said cylinder block with a face of said belt case in direct facing relation to a surface of said cylinder block, means defining an insulating layer between said belt case face and said cylinder block surface for limiting the transfer of heat from said cylinder block to said belt, said insulating layer comprising an air gap formed between each cylinder bank and the respective belt case arm, means for permitting air to flow through the interior of said belt case from an inlet drawn from the air gap between said belt case and said cylinder block, and a cooling fan driven from the valve train associated with the staggered cylinder block and positioned in the area of the stagger for circulating air through said belt case.

2. In an internal combustion engine comprising a cylinder block having a cylinder bore, a cylinder head closing said cylinder bore, valve means in said cylinder head for controlling flow, a piston received within said cylinder bore and driving an output shaft journaled in a crankcase positioned at the end of said cylinder bore opposite to said cylinder head, and a toothed belt driving said valve means from said output shaft, the improvement comprising a belt case enclosing at least in substantial part said toothed belt, and means defining an insulating layer between said belt case and said cylinder block for limiting the transfer of heat from said cylinder block to said belt, said belt case being formed with cooling air fins.

3. In an internal combustion engine as set forth in claim 2 further including means for permitting air to flow through the interior of the belt case.

4. In an internal combustion engine as set forth in claim 3 wherein the insulating layer comprises an air gap formed between the belt case face and the cylinder block surface.

5. In an internal combustion engine as set forth in claim 4 wherein the inlet for the air circulating through the belt case is drawn from the air gap between the belt case and the cylinder block.

6. In an internal combustion engine as set forth in claim 3 further including a cooling fan for circulating air through the belt case.

7. In an internal combustion engine as set forth in claim 6 wherein the insulating layer comprises an air gap formed between the belt case face and the cylinder block surface.

8. In an internal combustion engine as set forth in claim 7 wherein the insulating layer comprises an air gap formed between the belt case face and the cylinder block surface.

9. In an internal combustion engine comprising a cylinder block having a cylinder bore, a cylinder head closing said cylinder bore, valve means in said cylinder head for controlling flow, a piston received within said cylinder bore and driving an output shaft journaled in a crankcase positioned at the end of said cylinder bore opposite to said cylinder head, and a toothed belt driving said valve means from said output shaft, the improvement comprising a belt case enclosing at least in substantial part said toothed belt, and means defining an insulating layer between said belt case and said cylinder block for limiting the transfer of heat from said cylinder block to said belt, and a generator contained within said belt case.

10. In an internal combustion engine as set forth in claim 9 wherein the insulating layer comprises an air gap formed between the belt case and the cylinder block.

11. In an internal combustion engine as set forth in claim 10 wherein the belt case is formed with cooling air fins.

12. In an internal combustion engine as set forth in claim 11 wherein the inlet for the air circulating through the belt case is drawn from the air gap between the belt case and the cylinder block.

13. In an internal combustion engine as set forth in claim 12 further including an air inlet disposed in proximity to the generator for permitting cooling air to flow across the generator.

14. In an internal combustion engine comprising a cylinder block having a cylinder bore, a cylinder head closing said cylinder bore, valve means in said cylinder head for controlling flow, a piston received within said cylinder boer and driving an output shaft journaled in a crankcase positioned at the end of said cylinder bore opposite to said cylinder head, and a toothed belt driving said valve means from said output shaft, the improvement comprising a belt case enclosing at least in substantial part said toothed belt and means for circulating cooling air through said belt case for cooling said toothed belt comprising a cooling fan driven by the valve train and disposed between said belt case and the portion of the engine containing said valve train.

15. In an internal combustion engine as set forth in claim 14 wherein the inlet is positioned between the belt case and the engine.

16. In an internal combustion engine as set forth in claim 14 wherein the means for circulating cooling air through the belt case includes an air inlet into the belt case disposed at a sheltered area for precluding the entry of foreign material into said inlet.

17. In an internal combustion engine as set forth in claim 16 wherein the inlet is positioned between the belt case and the engine.

18. In an internal combustion engine comprising a cylinder block having a cylinder bore, a cylinder closing said cylinder bore, valve means in said cylinder head for controlling flow, a piston received within said cylinder bore and driving an output shaft journaled in a crankcase positioned at the end of said cylinder bore opposite to said cylinder head, and a toothed belt driving said valve means from said output shaft, the improvement comprising a belt case enclosing at least in substantial part said toothed belt, means for circulating cooling air through said belt case for cooling said toothed belt, and a generator contained within said belt case.

19. In an internal combustion engine as set forth in claim 18 wherein the means for circulating cooling air through the belt case includes an air inlet into the belt case disposed at a sheltered area for precluding the entry of foreign material into said inlet.

20. In an internal combustion engine as set forth in claim 19 wherein the inlet is positioned between the belt case and the engine.

21. In an internal combustion engine as set forth in claim 18 further including a cooling fan for circulating air through the belt case.

22. In an internal combustion engine as set forth in claim 21 wherein the cooling fan is driven by the valve train.

23. In an internal combustion engine as set forth in claim 22 wherein the cooling fan is disposed between the belt case and the portion of the engine containing the valve train.

24. In an internal combustion engine as set forth in claim 23 further including an air inlet to the belt case in proximity to the generator for effecting cooling air flow across the generator.

25. In an internal combustion engine as set forth in claim 18 further including an inlet in the belt case in proximity to the generator for permitting cooling air to flow across the generator.

26. In an internal combustion engine comprising a cylinder block having a cylinder bore, a cylinder head closing said cylinder bore, valve means in said cylinder head for controlling flow, a piston received within said cylinder bore and driving an output shaft journaled in a crankcase positioned at the end of said cylinder bore opposite to said cylinder head, and a toothed belt driving said valve means from said output shaft, the improvement comprising a belt case enclosing at least in substantial part said toothed belt, and a generator contained within said belt case.

27. In an internal combustion engine as set forth in claim 26 further including means for circulating cooling air through the belt case and across the generator.

28. In an internal combustion engine as set forth in claim 27 further including an air inlet in the belt case in proximity to the generator for permitting cooling air to flow across the generator.

* * * * *